US010703121B2

(12) United States Patent
Furumido

(10) Patent No.: US 10,703,121 B2
(45) Date of Patent: Jul. 7, 2020

(54) MEDIUM TRANSPORT APPARATUS AND POSTPROCESSING APPARATUS

(71) Applicant: SEIKO EPSON CORPORATION, Tokyo (JP)

(72) Inventor: Tsuyoshi Furumido, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/367,033

(22) Filed: Mar. 27, 2019

(65) Prior Publication Data

US 2019/0299688 A1 Oct. 3, 2019

(30) Foreign Application Priority Data

Mar. 30, 2018 (JP) ..... 2018-069991

(51) Int. Cl.

| | |
|---|---|
| ***B41J 29/38*** | (2006.01) |
| ***B65H 31/34*** | (2006.01) |
| ***B41J 2/01*** | (2006.01) |
| ***B41J 11/00*** | (2006.01) |

(52) U.S. Cl.

CPC ..... *B41J 29/38* (2013.01); *B41J 2/01* (2013.01); *B41J 11/0085* (2013.01); *B65H 31/34* (2013.01); *B65H 2801/06* (2013.01)

(58) Field of Classification Search

CPC . B41J 29/38; B41J 11/0085; B41J 2/01; B41J 29/377; B65H 31/34; B65H 2801/06; B65H 2406/323; B65H 31/02; B65H 31/30; B65H 31/26; B65H 29/56; B65H 29/242; B65H 2301/4474; B65H 2701/1829; B65H 2403/942; B65H 2801/27; B65H 2405/11151; B65H 2301/4213; B65H 2301/4212; B65H 2404/2693; B65H 2301/44734

See application file for complete search history.

(56) References Cited

U.S. PATENT DOCUMENTS

2007/0165092 A1* 7/2007 Kito ..... B41J 11/0065 347/102

FOREIGN PATENT DOCUMENTS

| | | | | |
|---|---|---|---|---|
| JP | 59143849 A | * | 8/1984 | ..... B65H 31/06 |
| JP | S63-171764 A | | 7/1988 | |
| JP | H11-334943 A | | 12/1999 | |
| JP | 2008105849 A | * | 5/2008 | ..... B65H 31/34 |

(Continued)

*Primary Examiner* — Henok D Legesse

(74) *Attorney, Agent, or Firm* — Workman Nydegger

(57) ABSTRACT

A transport mechanism includes a transport belt in which holes are formed and a suction clinging mechanism. The transport mechanism transports the medium in the first transporting direction, and when the upstream edge reaches a switching position, the transport mechanism transports the medium in the second transporting direction and stacks the medium in a stacker. The suction clinging mechanism includes an opening of a first suction chamber and an opening of a second suction chamber, and the opening of the first suction chamber is located downstream of the opening of the second suction chamber in the first transporting direction. The switching position is located upstream of the opening of the first suction chamber in the first transporting direction. In the first transporting direction, the distance from the switching position to the opening of the first suction chamber is longer than the length of each hole.

6 Claims, 11 Drawing Sheets

(56) References Cited

FOREIGN PATENT DOCUMENTS

| | | | | | |
|---|---|---|---|---|---|
| JP | 2008-266020 | A | | 11/2008 | |
| JP | 2018154413 | A | * | 10/2018 | ..... B65H 31/36 |

* cited by examiner

MEDIUM TRANSPORT APPARATUS AND POSTPROCESSING APPARATUS

CROSS REFERENCES TO RELATED APPLICATIONS

The entire disclosure of Japanese Patent Application No. 2018-069991, filed on Mar. 30, 2018 is expressly incorporated by reference herein.

BACKGROUND

1. Technical Field

The present disclosure relates to a medium transport apparatus, an example of which is an ink jet type printer, and a postprocessing apparatus.

2. Related Art

JP-A-2008-266020 discloses a stacking apparatus, which is an example of a postprocessing apparatus. The stacking apparatus transports a sheet, which is a type of medium, while the sheet is cling to a belt. The stacking apparatus draws air through a plurality of holes formed in the belt and thereby cling the sheet to the belt.

In the stacking apparatus disclosed by JP-A-2008-266020, covering the holes of the belt with a medium causes the medium to cling to the belt. If there is a hole that is not covered with the medium when transporting the medium, air enters the hole. In this case, a sufficient amount of clinging power required to cling the medium to the belt may not be obtained, which may fail to transport the medium stably. Suppose that a medium is transported in a switchback manner (so-called switchback transportation) when the medium cling to the belt is transported. In such switchback transportation, the medium is transported while the rotation direction of the belt is switched between a first rotating direction and a second rotating direction that is opposite to the first rotating direction. In the configuration proposed by JP-A-2008-266020, during the switchback transportation, there is no other means for transporting the medium except for the belt that transports the medium cling thereto. Under this condition, if the clinging power required for cling the medium decreases, the medium may not be transported stably.

SUMMARY

An advantage of some aspects of the disclosure is that a medium processing apparatus and a postprocessing apparatus that can transport a medium stably is provided.

Implementation and advantageous effects will be described. A medium transport apparatus according to an aspect of the disclosure includes a transport mechanism that transports a medium and a stacker that stacks the medium transported by the transport mechanism. In the medium transport apparatus, the transport mechanism includes a transport belt in which a plurality of holes are formed and that has an loop shape and is transported in a first transporting direction and in a second transporting direction that is opposite to the first transporting direction, a suction clinging mechanism that includes an opening of a first suction chamber and an opening of a second suction chamber that is located upstream of the opening of the first suction chamber in the first transporting direction, the opening of the first suction chamber and the opening of the second suction chamber drawing air through the holes, the suction clinging mechanism causes the medium to cling to the transport belt, and a rotation mechanism that moves the transport belt in the first transporting direction by rotating in a first rotating direction and that moves the transport belt in the second transporting direction by rotating in a second rotating direction that is opposite to the first rotating direction and thereby moves the transport belt in the second transporting direction. In addition, the transport mechanism transports the medium in the first transporting direction, and after an upstream edge of the medium in the first transporting direction is transported to a switching position, the transport mechanism transports the medium in the second transporting direction and stacks the medium in the stacker. The switching position is located upstream of the opening of the first suction chamber in the first transporting direction, and a distance from the switching position to the opening of the first suction chamber in the first transporting direction is longer than a length of each of the holes in the first transporting direction.

When the transport mechanism transports a medium and the upstream edge of the medium in the first transporting direction reaches the switching position, the transporting direction of the medium is switched from the first transporting direction to the second transporting direction. At this time, the holes being in communication with the first suction chamber are covered by the medium, which causes the medium to cling to the transport belt. If the holes that are not covered by the medium are in communication with the first suction chamber when the transporting direction of the medium is switched, an clinging power required to cause the medium to cling to the transport belt may not be obtained.

According to the above configuration, the distance from the switching position to the opening of the first suction chamber in the first transporting direction is longer than the length of each hole in the first transporting direction. Accordingly, when the transporting direction of the medium is switched, the holes that are not covered by the medium are not positioned so as to communicate with the first suction chamber. Thus, the clinging power required to cause a medium to cling to the transport belt is obtained. The medium can be transported stably.

In the medium transport apparatus, it is preferable that the length of the opening of the first suction chamber in the first transporting direction be longer than a pitch of adjacent ones of the holes in the first transporting direction. With this configuration, when the medium is transported, a desired aggregate area of the holes that are in communication with the opening of the first suction chamber can be obtained. The clinging power required to cause a medium to cling to the transport belt is thereby obtained. Assuming that the length of the opening of the first suction chamber in the first transporting direction is shorter than the pitch of adjacent holes in the first transporting direction, the suction power of the first suction chamber corresponding to the length of the first suction chamber varies largely depending on the positional relationship between the opening of the first suction chamber and the holes that are in communication with the opening of the first suction chamber. In this case, the clinging power required to cause a medium to cling to the transport belt may not be obtained. With above-described configuration, however, such a problem can be avoided.

In the medium transport apparatus, it is preferable that in a direction orthogonally intersecting the transporting direction of the medium, a length in a region in which the holes are formed be shorter than a length of the medium in the transport mechanism.

With this configuration, holes arranged in the direction orthogonally intersecting the transporting direction are covered by a medium transported. This suppresses the likelihood of the clinging power decreasing due to the holes not covered by the medium. It is preferable that the medium processing apparatus further include a separation flap that separates the medium cling to the transport belt from the transport belt, and another transport belt that arrayed in a direction orthogonal to the transporting direction of the medium with respect to the transport belt. In the medium processing apparatus, the separation flap is located at a position that is at least between the transport belt and the other transport belt in the direction orthogonally intersecting the transporting direction and that is upstream from the switching position in the first transporting direction.

With this configuration, the medium transported in the second transporting direction are separated from the transport belt due to the separation flap touching the medium. The medium transported by the transport belt can be thereby stacked readily on the stacker.

It is preferable that the medium transport apparatus further include a separation mechanism that separates the medium cling to the transport belt from the transport belt at a position downstream of the switching position in the first transporting direction.

With this configuration, while the separation flap separates the upstream edge of the medium in the first transporting direction from the transport belt, the separation mechanism also separates the downstream edge of the medium in the first transporting direction from the transport belt. The medium transported by the transport belt can be thereby stacked readily on the stacker.

A postprocessing apparatus according to another aspect of the disclosure includes a transport mechanism that transports a medium, an intermediate stacker that stacks the medium transported by the transport mechanism, and a postprocessing mechanism that performs postprocessing on the medium that is stacked in the intermediate stacker. In the postprocessing apparatus, the transport mechanism includes a transport belt in which a plurality of holes are formed and that has a loop shape and is transported in a first transporting direction and in a second transporting direction that is opposite to the first transporting direction, a suction clinging mechanism that includes an opening of a first suction chamber and an opening of a second suction chamber that is located upstream of the opening of the first suction chamber in the first transporting direction, the opening of the first suction chamber and the opening of the second suction chamber drawing air through the holes, the suction clinging mechanism causes the medium to cling to the transport belt, and a rotation mechanism that moves the transport belt in the first transporting direction by rotating in a first rotating direction and that moves the transport belt in the second transporting direction by rotating in a second rotating direction that is opposite to the first rotating direction and thereby moves the transport belt in the second transporting direction. In addition, the transport mechanism transports the medium in the first transporting direction, and after an upstream edge of the medium in the first transporting direction is transported to a switching position, the transport mechanism transports the medium in the second transporting direction and stacks the medium in the intermediate stacker. The switching position is located upstream of the opening of the first suction chamber in the first transporting direction. A distance from the switching position to the opening of the first suction chamber in the first transporting direction is longer than a length of each of the holes in the first transporting direction.

With this configuration, advantageous effects similar to those obtained by the medium processing apparatus can be also provided.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

An embodiment of a medium processing apparatus having a postprocessing apparatus will be described with reference to the drawings. The medium processing apparatus is, for example, an ink jet type printer that records images, such as characters and photographs, on a medium, such as a sheet of paper, by ejecting ink, which is an example of a liquid, onto the medium.

Figure 1:
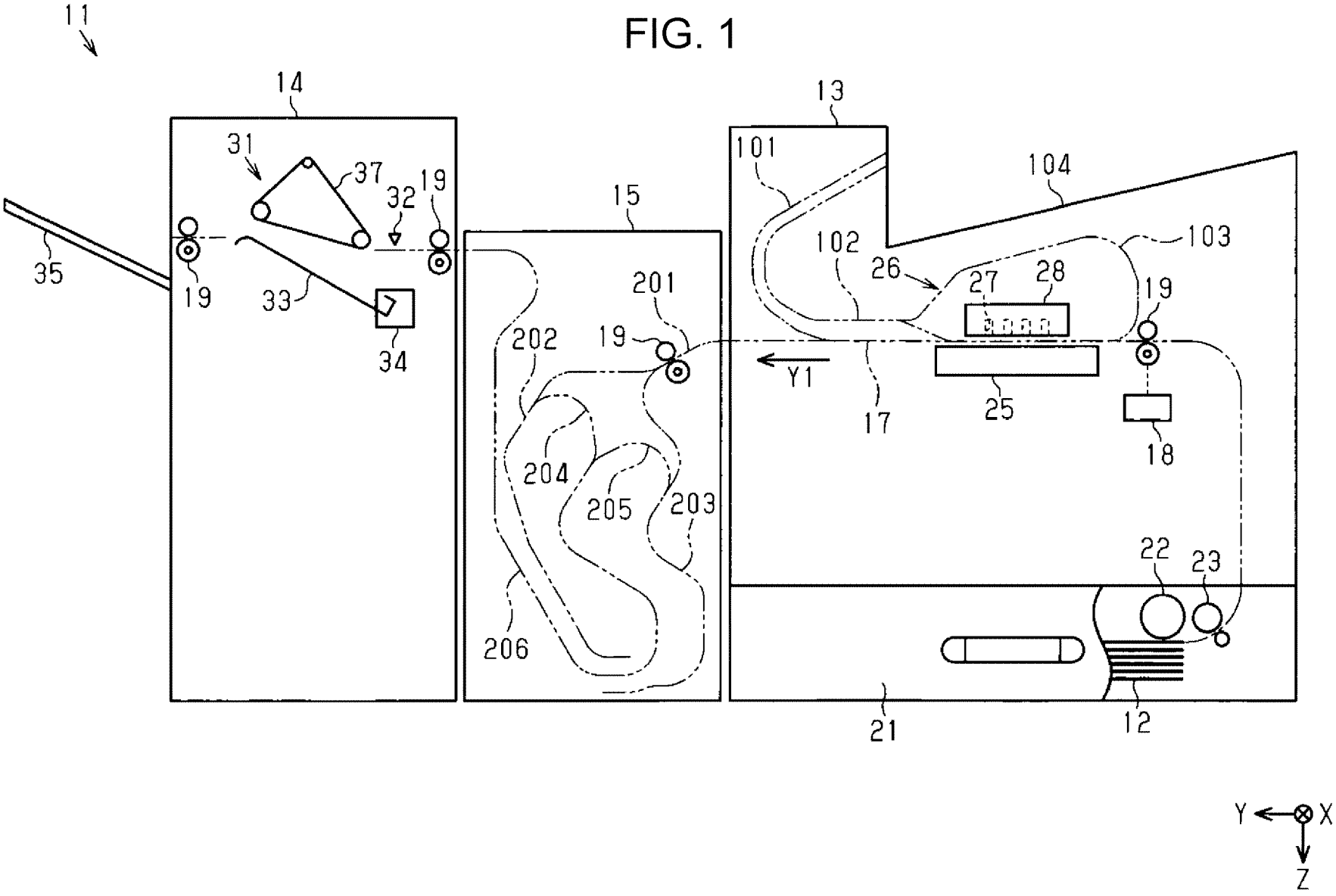
FIG. 1 is a side view schematically illustrating an embodiment of a medium processing apparatus having a postprocessing apparatus.

As illustrated in FIG. 1, a medium processing apparatus 11 includes a printing apparatus 13 that performs recording onto a medium 12, a postprocessing apparatus 14 that performs postprocessing on the medium 12 on which recording has been performed, and an intermediate apparatus 15 that is positioned between the printing apparatus 13 and the postprocessing apparatus 14. The postprocessing is a processing that accompanies the recording. As the postprocessing, the postprocessing apparatus 14 according to the present embodiment staples a plurality of media 12 by using a stapler.

As indicated by the dash-dot-dot lines in FIG. 1, a transport path 17 is disposed in the medium processing apparatus 11. The transport path 17 continues from the printing apparatus 13 to the postprocessing apparatus 14 via the intermediate apparatus 15. The medium processing apparatus 11 includes at least one transport roller pair 19 that is driven by a transport motor 18 and thereby transports a medium 12 along the transport path 17. Note that the intermediate apparatus 15 and the postprocessing apparatus 14 may include an individual transport motor 18 so as to drive a transport roller pair 19 included in each apparatus. Moreover, each of the printing apparatus 13, the intermediate apparatus 15, and the postprocessing apparatus 14 may include a plurality of transport motors 18. Thus, a plurality of transport roller pairs 19 included in the printing apparatus 13, the intermediate apparatus 15, and the postprocessing apparatus 14 may be controlled efficiently.

In the drawings, the gravitational direction is represented by the Z-axis, assuming that the medium processing apparatus 11 is placed on a horizontal surface. The other two directions that extend on a plane that intersects the Z-axis are represented by the X-axis and the Y-axis. The X-axis, the Y-axis, and the Z-axis preferably intersect each other orthogonally, and the X-axis and the Y-axis extend along the horizontal surface. In the following description, the X-axis direction and the Z-axis direction are also referred to as "the width direction X" and "the vertical direction Z", respectively. The direction that intersects the width direction X and extends along the transport path 17 is also referred to as "the first transporting direction Y1". The first transporting direction Y1 is a direction in which the transport roller pair 19 transports a medium 12, in other words, a direction extending from the printing apparatus 13 located upstream to the postprocessing apparatus 14 located downstream.

A cassette 21 that can accommodate media 12 in a stacked manner is detachably disposed in the printing apparatus 13. A plurality of the cassettes 21 may be detachably disposed in the printing apparatus 13. The printing apparatus 13 includes a pickup roller 22 and a separation roller 23. The pickup roller 22 picks up the top most portion of the media 12 accommodated in the cassette 21, and the separation roller 23 separates the media 12 picked up by the pickup roller 22 one by one.

The printing apparatus 13 includes a support platform 25 that supports a medium 12 and also includes a recording section 26 that records an image onto the medium 12 supported by the support platform 25. The support platform 25 is disposed at a position along the transport path 17. The recording section 26 includes a recording head 28 that ejects liquid from nozzles 27. The recording head 28 is disposed at a position that opposes the support platform 25 with the transport path 17 interposed therebetween. The recording head 28 may be a so-called "line head" that can eject liquid simultaneously from nozzles that are arranged in the width direction X, or may be a so-called "serial head" that ejects liquid while the head moves in the width direction X.

The printing apparatus 13 includes, as part of the transport path 17, a discharge path 101 for discharging a medium 12, a switchback path 102 for transporting a medium 12 in a switchback manner, and an inversion path 103 for inverting the orientation of a medium 12. The discharge path 101 is a path along which a medium 12 on which the recording section 26 has performed recording is discharged toward a discharge section 104. The discharge section 104 is located in the top portion of the printing apparatus 13. The medium 12 that has been transported along the discharge path 101 is placed on the discharge section 104.

The switchback path 102 and the inversion path 103 are paths for transporting a medium 12 in the case of double-sided printing. The switchback path 102 is disposed so as to extend along the discharge path 101. The inversion path 103 extends from the switchback path 102. The inversion path 103 extends from a region downstream of the recording head 28 toward a region upstream thereof so as to pass over the recording head 28.

In the case of the double-sided printing, a medium 12 of which printing has been performed on one side is first transported to the switchback path 102. The medium 12 is subsequently switched back on the switchback path 102. In other words, the medium 12 is transported in the opposite direction by the switchback path 102. The medium 12 is subsequently transported from the switchback path 102 to the inversion path 103.

While the medium 12 is transported along the switchback path 102 and the inversion path 103, the medium 12 is inverted from the orientation in which a printed side faces upward to the orientation in which the printed side faces downward. The recording section 26 performs recording again on the medium 12 that has been transported along the inversion path 103. At this time, printing is performed on a side of the medium 12 that is opposite to the side on which printing has been previously performed. Thus, the printing apparatus 13 performs double-sided printing on a medium 12. The printing apparatus 13 transports the medium 12 on which printing has been performed to the discharge section 104 or to the intermediate apparatus 15.

The intermediate apparatus 15 includes, as part of the transport path 17, an introduction path 201, a first switchback path 202, a second switchback path 203, a first merging path 204, a second merging path 205, and an exit path 206. The introduction path 201 is a path for introducing a medium 12 from the printing apparatus 13. The first switchback path 202 and the second switchback path 203 are paths that extend from the introduction path 201 and along which the medium 12 is transported in a switchback manner. The first switchback path 202 and the second switchback path 203 are branched from the introduction path 201.

The first merging path 204 is a path extending from the first switchback path 202. The second merging path 205 is a path extending from the second switchback path 203. The exit path 206 is a path that extends from the first merging path 204 and the second merging path 205 and on which the medium 12 exits the intermediate apparatus 15 toward the postprocessing apparatus 14. The first merging path 204 and the second merging path 205 are merged in the exit path 206.

A medium 12 that is transported from the printing apparatus 13 to the intermediate apparatus 15 enters the introduction path 201. The medium 12 that has entered the introduction path 201 is further transported to the first switchback path 202 or to the second switchback path 203. The medium 12 coming from the introduction path 201 is sorted into the first switchback path 202 or into the second switchback path 203 by a flap or the like disposed at a position at which the first switchback path 202 and the second switchback path 203 are branched from the introduction path 201.

A medium 12 transported into the first switchback path 202 is switched back on the first switchback path 202. The medium 12, which has been switched back on the first switchback path 202, is transported into the first merging path 204. The medium 12 that comes from the first merging path 204 is transported into the exit path 206.

A medium 12 transported from the introduction path 201 into the second switchback path 203 is switched back on the second switchback path 203. The medium 12, which has been switched back on the second switchback path 203, is transported into the second merging path 205. The medium 12 that comes from the second merging path 205 is transported into the exit path 206.

A medium 12 transported through the intermediate apparatus 15 is switched back on the first switchback path 202 or on the second switchback path 203. As a result, the medium 12 transported through the intermediate apparatus 15 is inverted from the orientation in which a newly printed side (i.e., the side on which printing has been performed immediately before in the printing apparatus 13) faces upward to the orientation in which the newly printed side faces downward. Thus, a medium 12 exiting the intermediate apparatus 15 to the postprocessing apparatus 14 assumes the orientation in which the newly printed side faces downward. Transporting a medium 12 through the intermediate apparatus 15 provides time for drying the medium 12 onto which liquid has been ejected. Providing time for drying the medium 12 reduces the likelihood, for example, of transfer of liquid ejected onto the medium 12 or of the medium 12 curling due to the water contained in the ejected liquid.

Next, the postprocessing apparatus 14 will be described. As illustrated in FIG. 1, the postprocessing apparatus 14 includes a transport mechanism 31 that transports a medium 12 on which the recording section 26 has performed recording, and also includes a detection device 32 that is disposed at a position upstream of the transport mechanism 31 in the first transporting direction Y1. The detection device 32 detects a medium 12 that is transported on the transport path 17. The postprocessing apparatus 14 also includes an intermediate stacker 33, which is an example of a stacker on which media 12 transported by the transport mechanism 31 are stacked. The postprocessing apparatus 14 further includes a postprocessing mechanism 34 and a discharge stacker 35. The postprocessing mechanism 34 performs postprocessing on media 12 stacked on the intermediate stacker 33. The media 12 transported from the intermediate stacker 33 are stacked on the discharge stacker 35. In other words, the media 12 are piled up in an overlapping manner on the discharge stacker 35.

Figure 2:
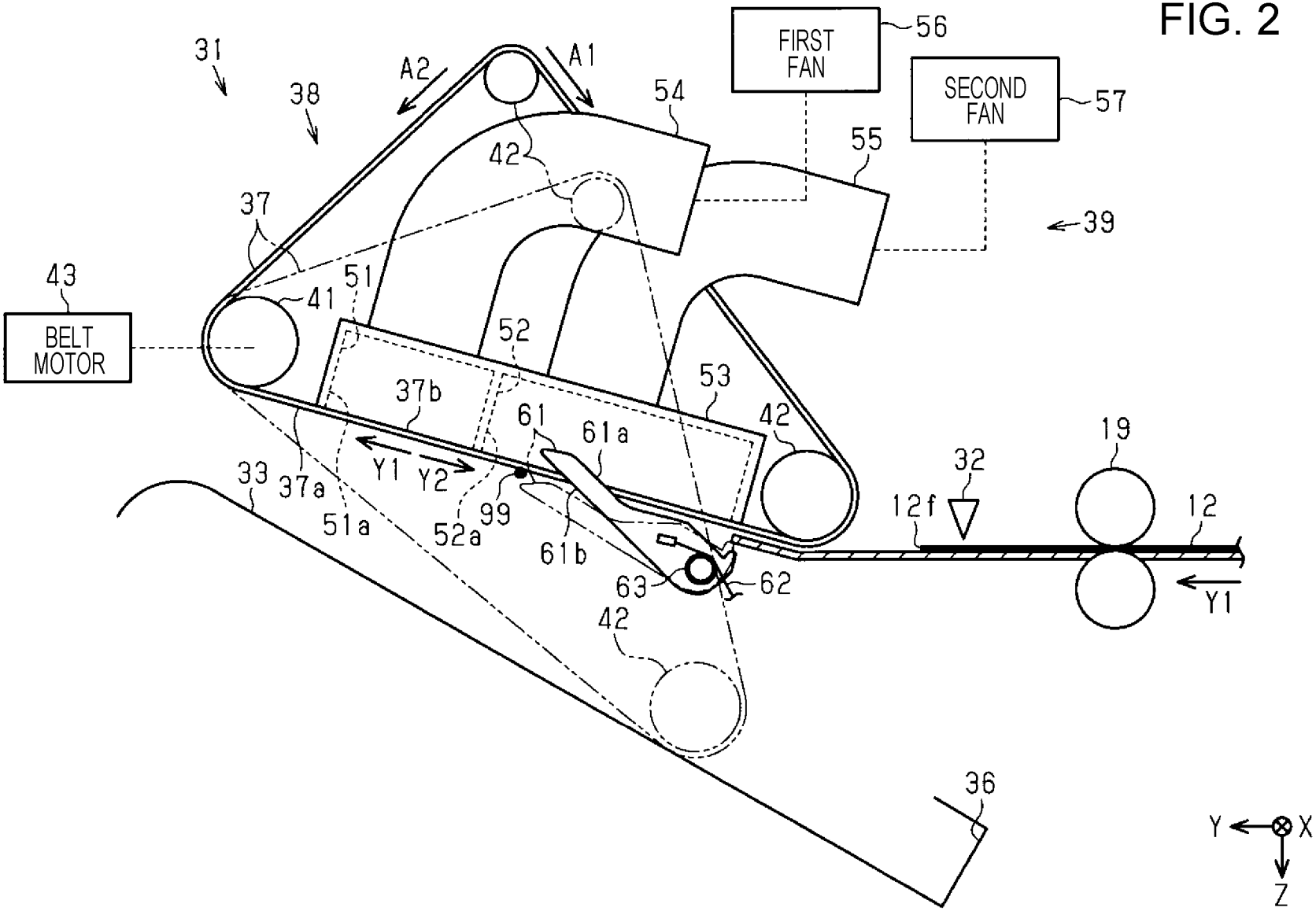
FIG. 2 is a side view schematically illustrating a transport mechanism and an intermediate stacker that are included in the postprocessing apparatus.

As illustrated in FIG. 2, the intermediate stacker 33 includes an orderly arrangement portion 36 that lines up the edges of stacked media 12. The intermediate stacker 33 is disposed in an inclined manner such that an edge of a medium 12 near the orderly arrangement portion 36 is positioned lower than the opposite edge of the medium 12 in the vertical direction Z.

The transport mechanism 31 includes a transport belt 37 that is loop shape, a rotation mechanism 38 that causes the transport belt 37 to rotate, and a suction clinging mechanism 39 that causes a medium 12 to cling to the transport belt 37. The transport belt 37 is located in a region above the intermediate stacker 33. The transport mechanism 31 according to the present embodiment starts to operate when the detection device 32 detects the downstream edge of a medium 12 in the first transporting direction Y1. In other words, the transport mechanism 31 starts to operate when the detection device 32 detects the front edge 12*f* of a medium 12 that is an edge positioned downstream in the first transporting direction Y1.

The rotation mechanism 38 includes a drive pulley 41 and an idler pulley 42 around which the transport belt 37 extends and also includes a belt motor 43 that causes the drive pulley 41 to rotate. The idler pulley 42 is rotatable around an axis that is parallel to the axis of the drive pulley 41. The rotation mechanism 38 according to the present embodiment includes two idler pulleys 42.

The transport belt 37 extends around the drive pulley 41 and the idler pulleys 42 so as to form a shape like an loop triangle. Actuating the belt motor 43 causes the transport belt 37 to rotate around the drive pulley 41 and the idler pulleys 42. More specifically, the rotation mechanism 38 causes the transport belt 37 to move in a first rotating direction A1 by rotating the belt motor 43 in a normal rotation direction. Alternatively, the rotation mechanism 38 causes the transport belt 37 to move in a second rotating direction A2, which is opposite to the first rotating direction A1, by rotating the belt motor 43 in a reverse rotation direction.

The transport mechanism 31 is disposed such that the transport mechanism 31 can rotate with the drive pulley 41 as the pivot. In other words, as illustrated in FIG. 2, the position of the transport belt 37 is displaceable between a contact position indicated by the dash-dot-dot line in FIG. 2 and a retreat position indicated by the solid line in FIG. 2. The contact position is a position at which the transport belt 37 comes into contact with media 12 stacked on the intermediate stacker 33. The retreat position is a position at which the transport belt 37 is more distant from the intermediate stacker 33 than at the contact position.

The suction clinging mechanism 39 includes a first suction chamber 51 and a second suction chamber 52 for drawing a medium 12. The suction clinging mechanism 39 is provided with a suction device 53 that is shaped like a box and in which the first suction chamber 51 and the second suction chamber 52 are disposed. The suction clinging mechanism 39 also includes a first duct 54 and a second duct 55 that extend from the suction device 53. The first duct 54 is in communication with the first suction chamber 51. The second duct 55 is in communication with the second suction chamber 52. The suction clinging mechanism 39 further includes a first fan 56 that draws air from the first suction chamber 51 via the first duct 54 and a second fan 57 that draws air from the second suction chamber 52 via the second duct 55.

The suction device 53 is located in a region surrounded by the transport belt 37. In the suction device 53, the first suction chamber 51 and the second suction chamber 52 open toward the intermediate stacker 33. In other words, the suction clinging mechanism 39 has an opening 51*a* of the first suction chamber 51 and an opening 52*a* of the second suction chamber 52. The suction device 53 is disposed such that part of the first suction chamber 51 and part of the second suction chamber 52 are covered by the transport belt 37. In other words, the opening 51*a* of the first suction chamber 51 and the opening 52*a* of the second suction chamber 52 are covered by the transport belt 37. The suction clinging mechanism 39 causes a medium 12 to be drawn by the first suction chamber 51 and the second suction chamber 52 with the transport belt 37 interposed therebetween and thereby causes the medium 12 to cling to the transport belt 37. The suction clinging mechanism 39 causes a medium 12 to cling to the outside surface of the transport belt 37. The outside surface of the transport belt 37 is referred to as "a clinging surface 37*a*" to which a medium 12 is cling. An inside surface 37*b* of the transport belt 37 is in contact with the suction device 53.

The first suction chamber 51 is positioned downstream of the second suction chamber 52 in the first transporting direction Y1. In the present embodiment, the opening 51*a* of the first suction chamber 51 is positioned downstream of the opening 52*a* of the second suction chamber 52 in the first transporting direction Y1. The first suction chamber 51 and the second suction chamber 52 are separated from each other in the suction device 53. However, the first suction chamber 51 and the second suction chamber 52 may be disposed in separate suction devices 53. In other words, a suction device 53 that has the second suction chamber 52 and another suction device 53 that has the first suction chamber 51 may be arranged in a row in the first transporting direction Y1.

The transport mechanism 31 causes a medium 12 to cling to the transport belt 37 and transports the medium 12 in a region between the transport belt 37 and the intermediate stacker 33 by rotating the transport belt 37. The transport mechanism 31 transports a medium 12 in the first transporting direction Y1 by rotating the transport belt 37 to which the medium 12 is cling in the first rotating direction A1. When the upstream edge of the medium 12 in the first transporting direction Y1 reaches a switching position 99, the transport mechanism 31 causes the transport belt 37 to rotate in the second rotating direction A2. The transport mechanism 31 transports a medium 12 in a second transporting direction Y2, which is opposite to the first transporting direction Y1, by rotating the transport belt 37 to which the medium 12 is cling in the second rotating direction A2. The transport mechanism 31 transports a medium 12 in the second transporting direction Y2 and subsequently stacks the medium 12 on the intermediate stacker 33. In other words, the transport mechanism 31 switches the transporting direction of a medium 12 during transportation of the medium 12.

The switching position 99 is located upstream of the first suction chamber 51 in the first transporting direction Y1. More specifically, the switching position 99 is located upstream of the opening 51*a* of the first suction chamber 51 in the first transporting direction Y1. In the present embodiment, the switching position 99 is set depending on an elapsed time for which the belt motor 43 is rotating in the normal rotation direction after the detection device 32 detects the upstream edge of a medium 12 in the first transporting direction Y1. In other words, when the transport mechanism 31 transports a medium 12, the transport mechanism 31 is controlled to switch the driving direction of the belt motor 43 before the upstream edge of the medium 12 in the first transporting direction Y1 reaches the first suction chamber 51.

With regard to setting the switching position 99, another sensor for detecting a medium 12 may be disposed at a position upstream of the first suction chamber 51 in the first transporting direction Y1. In this case, the transport mechanism 31 is controlled to switch the driving direction of the belt motor 43 when the sensor detects the upstream edge of the medium 12 in the first transporting direction Y1. In other words, the switching position 99 is set depending on a position at which the sensor is disposed.

The postprocessing apparatus 14 includes a separation flap 61 and a pressing member 62. The separation flap 61 separates a medium 12 cling to the transport belt 37 from the transport belt 37, and the pressing member 62 presses the separation flap 61. The separation flap 61 separates a medium 12 being transported in the second transporting direction Y2 from the transport belt 37. The separation flap 61 is disposed at a position upstream of the switching position 99 in the first transporting direction Y1. The pressing member 62 is, for example, a torsion spring.

The separation flap 61 has an upper flap surface 61*a*, which is an example of a first flap surface, and a lower flap surface 61*b*, which is an example of a second flap surface. The separation flap 61 also has a flap shaft 63. The separation flap 61 rotates around the flap shaft 63 to switch the position. The separation flap 61 can be positioned at a first flap position indicated by the solid line in FIG. 2 and at a second flap position indicated by the dash-dot-dot line in FIG. 2.

The pressing member 62 presses the separation flap 61 toward the first flap position. When the separation flap 61 is positioned at the first flap position, the upper flap surface 61*a* and the lower flap surface 61*b* intersect the clinging surface 37*a* of the transport belt 37 as viewed in the width direction X. When the separation flap 61 is positioned at the first flap position, the angle between the upper flap surface 61*a* and the clinging surface 37*a* is an acute angle, while the angle between the lower flap surface 61*b* and the clinging surface 37*a* is an obtuse angle.

Figure 3:
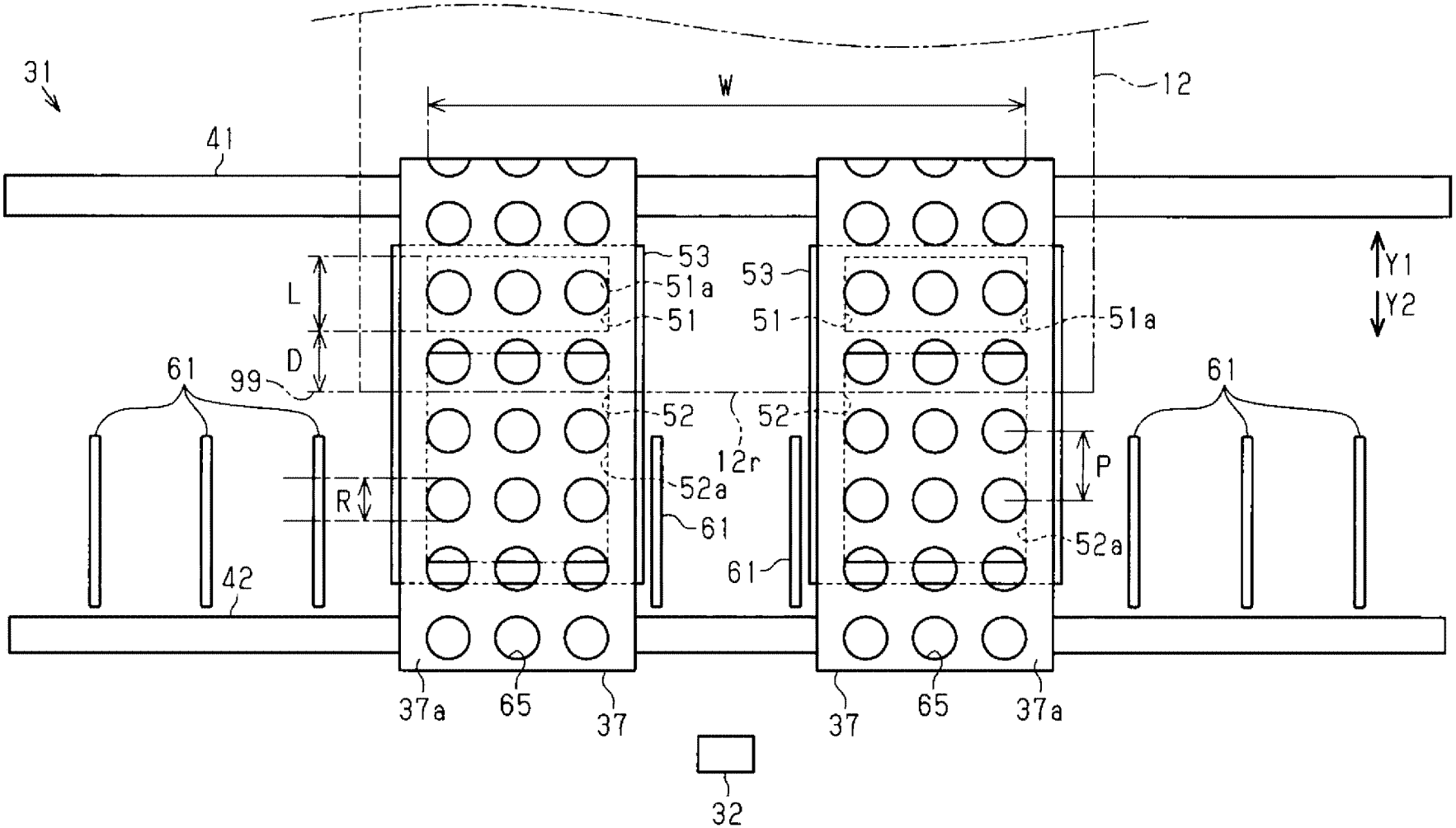
FIG. 3 is a bottom view schematically illustrating the transport mechanism.

As illustrated in FIG. 3, the transport belt 37 has a plurality of holes 65 formed therein. The holes 65 pass through the transport belt 37 so as to open on both clinging surface 37*a* and inside surface 37*b*. The holes 65 are aligned regularly on the transport belt 37. In the present embodiment, the holes 65 are arranged at regular intervals in the width direction X and in the extending direction of the transport belt 37. The holes 65 may be shaped like circles or rectangles. The first suction chamber 51 and the second suction chamber 52 that are covered by the transport belt 37 are open to atmosphere through the holes 65.

A plurality of transport belts 37 may be provided side by side in the width direction X. In other words, a plurality of transport belts 37 disposed side by side in the width direction X may extend around the drive pulley 41 and the idler pulleys 42. In the present embodiment, two of the transport belts 37 are disposed in the width direction X with a spacing therebetween. Two of the suction devices 53 according to the present embodiment are also disposed in the width direction X with a spacing therebetween so as to correspond to the transport belts 37. Alternatively, a single suction device 53 elongated in the width direction X may be disposed so as to correspond to a plurality of the transport belts 37.

In the suction clinging mechanism 39, actuating the first fan 56 and the second fan 57 supplies a negative pressure to the first suction chamber 51 and the second suction chamber 52. When a medium 12 covers the holes 65 that are in communication with the first suction chamber 51 and the second suction chamber 52, the negative pressure in the first suction chamber 51 and the second suction chamber 52 act on the medium 12 via the holes 65. When the negative pressure in the first suction chamber 51 and the second suction chamber 52 act on the medium 12, the medium 12 is caused to cling to the transport belt 37. The first suction chamber 51 and the second suction chamber 52 draw air through the holes 65 and thereby draw the medium 12. The suction clinging mechanism 39 draws air via the first suction chamber 51, the second suction chamber 52, and the holes 65 and thereby causes the medium 12 to cling to the clinging surface 37*a* of the transport belt 37.

The clinging power of a medium 12 generated by the suction clinging mechanism 39 increases as the area of holes 65 that are covered by the medium 12 increases with respect to the total area of the holes 65 that are in communication with the first suction chamber 51 and the second suction chamber 52. When holes 65 that are in communication with the first suction chamber 51 and the second suction chamber 52 are not covered by a medium 12, air enters the first suction chamber 51 and the second suction chamber 52 through the holes 65. This reduces the clinging power of the suction clinging mechanism 39.

When the upstream edge of a medium 12 in the first transporting direction Y1 is positioned at the switching position 99, the medium 12 is cling to the transport belt 37 mainly due to the negative pressure of the first suction chamber 51. If the clinging power generated by the negative pressure of the first suction chamber 51 decreases, the transport belt 37 may not transport the medium 12 stably.

When a distance D denotes a distance from the switching position 99 to the opening 51*a* of the first suction chamber 51 in the first transporting direction Y1, the distance D is longer than the length R of each hole 65 in the first transporting direction Y1. In other words, the switching position 99 is set in a region where the distance D is longer than the length R. Accordingly, when the upstream edge of a medium 12 in the first transporting direction Y1 is positioned at the switching position 99, holes 65 that are not covered by the medium 12 are not positioned so as to communicate with the first suction chamber 51. This reduces the likelihood of air entering the first suction chamber 51 through the holes 65 that are not covered by the medium 12. The clinging power required to cause a medium 12 to cling to the transport belt 37 is thereby obtained.

It is preferable that the length L of the opening 51*a* of the first suction chamber 51 in the first transporting direction Y1 be longer than the pitch P of adjacent holes 65 in the first transporting direction Y1. In other words, it is preferable that the first suction chamber 51 and the holes 65 be formed so as to satisfy length L pitch P. The pitch P of the holes 65 denotes the center-to-center distance between adjacent holes 65. With this configuration, when the transport mechanism 31 transports a medium 12, a desired area or more of the holes 65 that are in communication with the first suction chamber 51 can be obtained. The clinging power required to cause a medium 12 to cling to the transport belt 37 is thereby obtained.

In the transport mechanism 31, it is also preferable that in the width direction X, the width W of the region of the transport belt 37 in which holes 65 are formed be smaller than the width of a medium 12 in the width direction X. In other words, in the transport mechanism 31, the width W of the region in which holes 65 are formed is smaller than the width of a minimum size medium 12 on which the postprocessing apparatus 14 is able to perform postprocessing. With this configuration, irrespective of transporting a small size medium 12 or a large size medium 12, the holes 65 are covered by the medium 12 in the width direction X. This can suppress the likelihood of the clinging power decreasing. Note that the width direction X is a direction that orthogonally intersects the transporting direction of a medium 12. In a direction orthogonally intersecting the transporting direction of a medium 12, the length of a portion of a medium 12 stretching over the region in which the holes 65 are formed (i.e., the width W) is shorter than the length of the medium 12.

It is preferable that at least one separation flap 61 be disposed between the transport belts 37 in the width direction X. In the present embodiment, a plurality of the separation flaps 61 are disposed in a row in the width direction X with a spacing provided between adjacent separation flaps 61. With this configuration, even in the case of transporting a large size medium 12, the separation flaps 61 can separate a medium 12 from the transport belt 37 effectively.

Of a plurality of the separation flaps 61, the separation flap 61 located between a pair of the transport belts 37 commonly acts on every type of transported medium 12 to separate the medium 12 from the transport belt 37. Of a plurality of the separation flaps 61, at least a pair of separation flaps 61, which are not interposed between a pair of the transport belts 37, come into contact with respective side edge portions of a medium 12 and separate the medium 12 from the transport belt 37. With this configuration, in the case of transporting media 12 having different sizes, each medium 12 can be separated appropriately from the transport belt 37. Accordingly, it is preferable that the positions of separation flaps 61 that are not located between a pair of the transport belts 37 be determined on the basis of the standard sizes of medium 12 to be transported.

Figure 4:
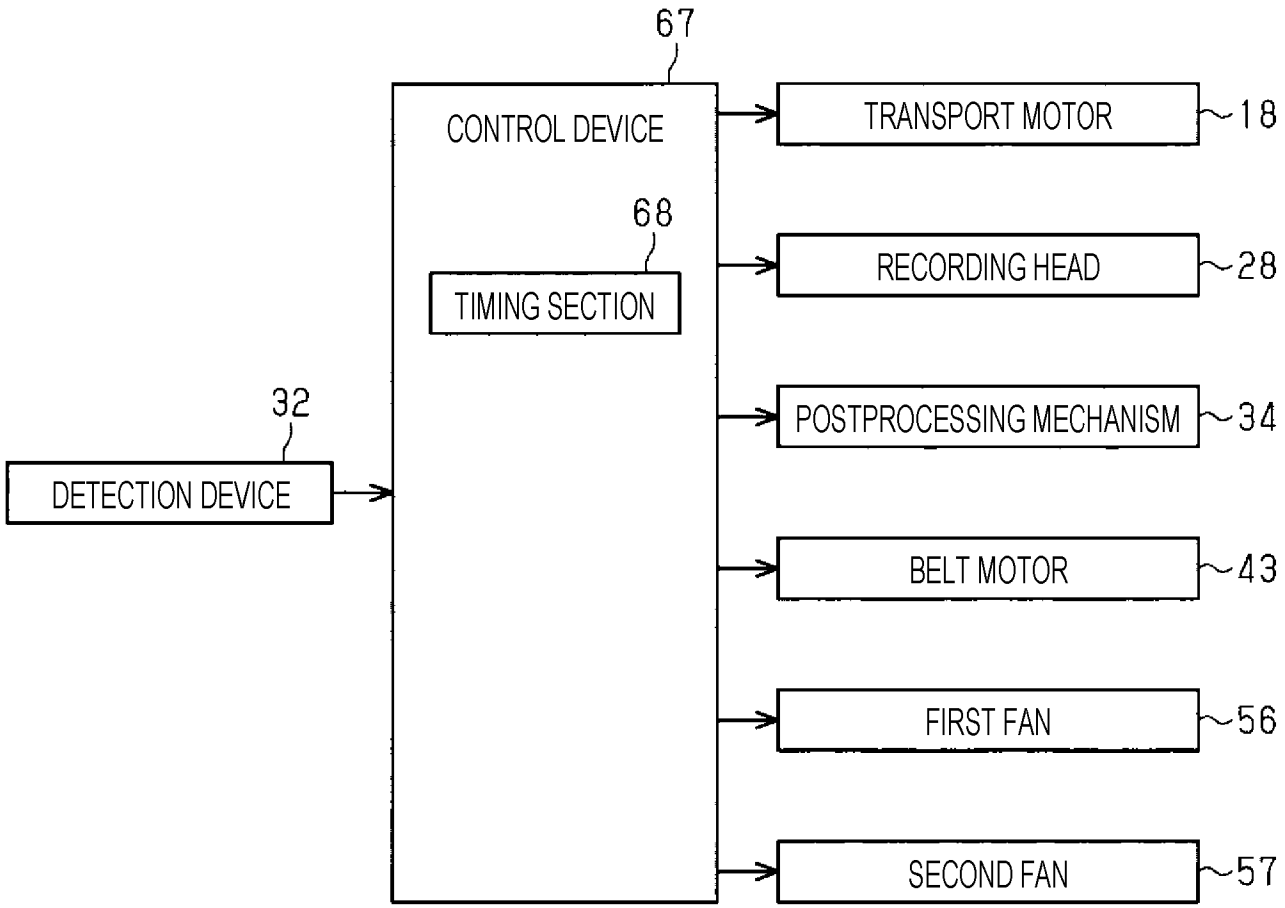
FIG. 4 is a block diagram illustrating an electrical configuration of the medium processing apparatus.

Next, an electrical configuration of the medium processing apparatus 11 will be described. As illustrated in FIG. 4, the medium processing apparatus 11 includes a control device 67 that integrally controls operation of each mechanism in the medium processing apparatus 11. The control device 67 includes a timing section 68 for timing. The control device 67 is connected to the detection device 32 so as to be able to receive signals. The detection device 32 sends a signal when the detection device 32 detects an edge of a medium 12. The control device 67 controls operation of the transport motor 18, the recording head 28, the postprocessing mechanism 34, the belt motor 43, the first fan 56, and the second fan 57 by sending signals to these devices.

Next, operation of the postprocessing apparatus 14 according to the present embodiment will be described. When the detection device 32 detects a medium 12 that is transported by the transport roller pair 19 in the first transporting direction Y1, the control device 67 actuates the first fan 56 and the second fan 57 in the state of the transport belt 37 being positioned at the retreat position. While the control device 67 actuates the first fan 56 and the second fan 57, the control device 67 also rotates the belt motor 43 in the normal rotation direction and thereby rotates the transport belt 37 in the first rotating direction A1.

Figure 5:
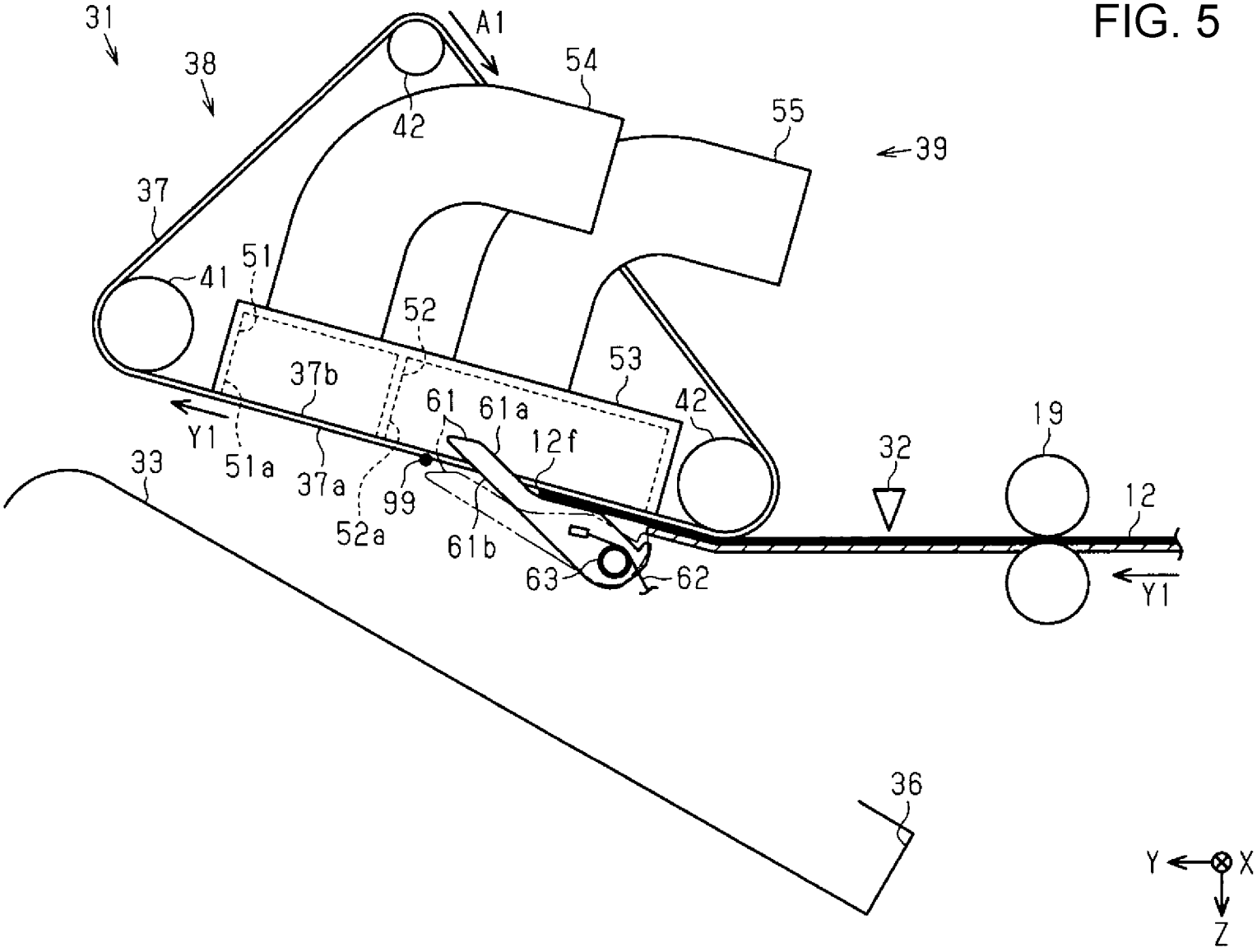
FIG. 5 is a side view schematically illustrating the transport mechanism that causes a medium to cling to a transport belt.

As illustrated in FIG. 5, when the medium 12 is transported to the transport belt 37, the suction clinging mechanism 39 causes the medium 12 to cling to the transport belt 37. At this time, the suction clinging mechanism 39 causes the second suction chamber 52 to draw a portion of the medium 12 near the front edge 12*f*, and the portion of the medium 12 is cling to the transport belt 37. The medium 12 cling to the transport belt 37 is transported in the first transporting direction Y1 due to the transport belt 37 rotating in the first rotating direction A1.

During transportation in the first transporting direction Y1, the medium 12 comes into contact with the separation flaps 61. At this time, the front edge 12*f* of the medium 12 comes into contact with the upper flap surface 61*a*. The medium 12 being transported in the first transporting direction Y1 pushes the separation flaps 61. The medium 12 pushes the separation flaps 61 and thereby causes the separation flaps 61 to rotate around the flap shaft 63 against the pressing forces of the respective pressing members 62. The separation flaps 61 are displaced from the first flap position indicated by the solid line in FIG. 5 to the second flap position indicated by the dash-dot-dot line.

Figure 6:
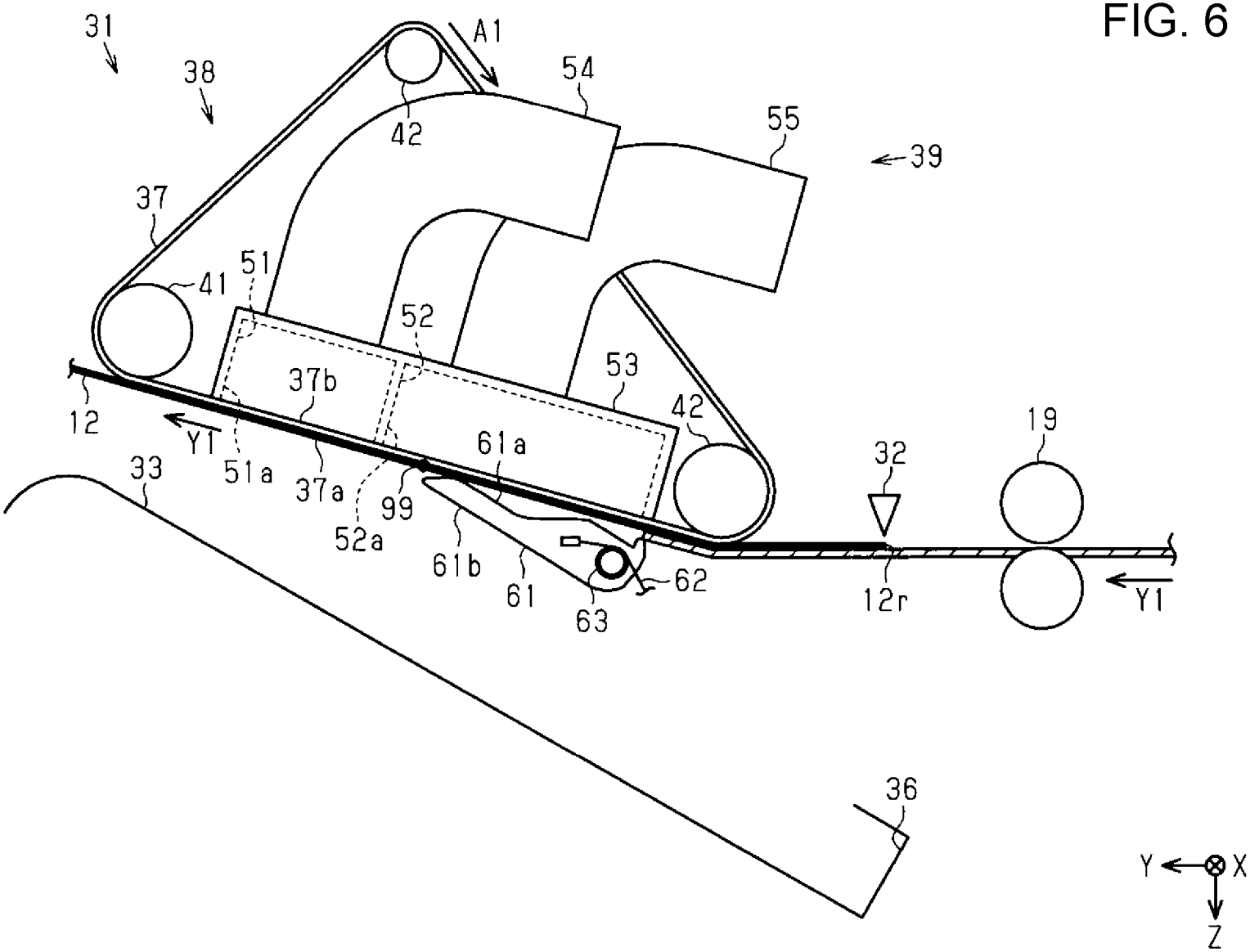
FIG. 6 is a side view schematically illustrating the transport mechanism that transports the cling medium in a first transporting direction.

As illustrated in FIG. 6, when the medium 12 passes the separation flaps 61, the medium 12 is pressed against the transport belt 37 by the separation flaps 61 that are urged by the pressing members 62. When the medium 12 passes the separation flaps 61, the medium 12 is transported so as to squeeze between the separation flaps 61 and the transport belt 37. When the medium 12 passes the separation flaps 61, the first suction chamber 51 causes a portion of the medium 12 near the front edge 12*f* to cling to the transport belt 37. Thus, when the medium 12 passes the separation flaps 61, the medium 12 is cling to the transport belt 37 by the first suction chamber 51 and the second suction chamber 52.

When the detection device 32 detects the rear edge 12*r* of the medium 12, in other words, the upstream edge of the medium 12 in the first transporting direction Y1, the control device 67 switches the driving direction of the belt motor 43 at a predetermined time interval after the detection. In other words, when the rear edge 12*r* is detected in the state of the belt motor 43 rotating in the normal rotation direction, the control device 67 allows the transport belt 37 to rotate in the first rotating direction A1 for a predetermined time interval by rotating the belt motor 43 in the normal rotation direction. The control device 67 temporarily stops rotation of the belt motor 43 at the predetermined time interval after the rear edge 12*r* of the medium 12 is detected. The control device 67 subsequently starts to rotate the transport belt 37 in the second rotating direction A2 by driving the belt motor 43 reversely.

Here, the predetermined time interval denotes the duration required for the rear edge 12*r* of the medium 12 to pass the separation flaps 61. The predetermined time interval is substantially equal to the quotient of the distance between the detection device 32 and the tip of the separation flap 61 along the transport path 17 divided by the speed of transporting a medium 12.

Figure 7:
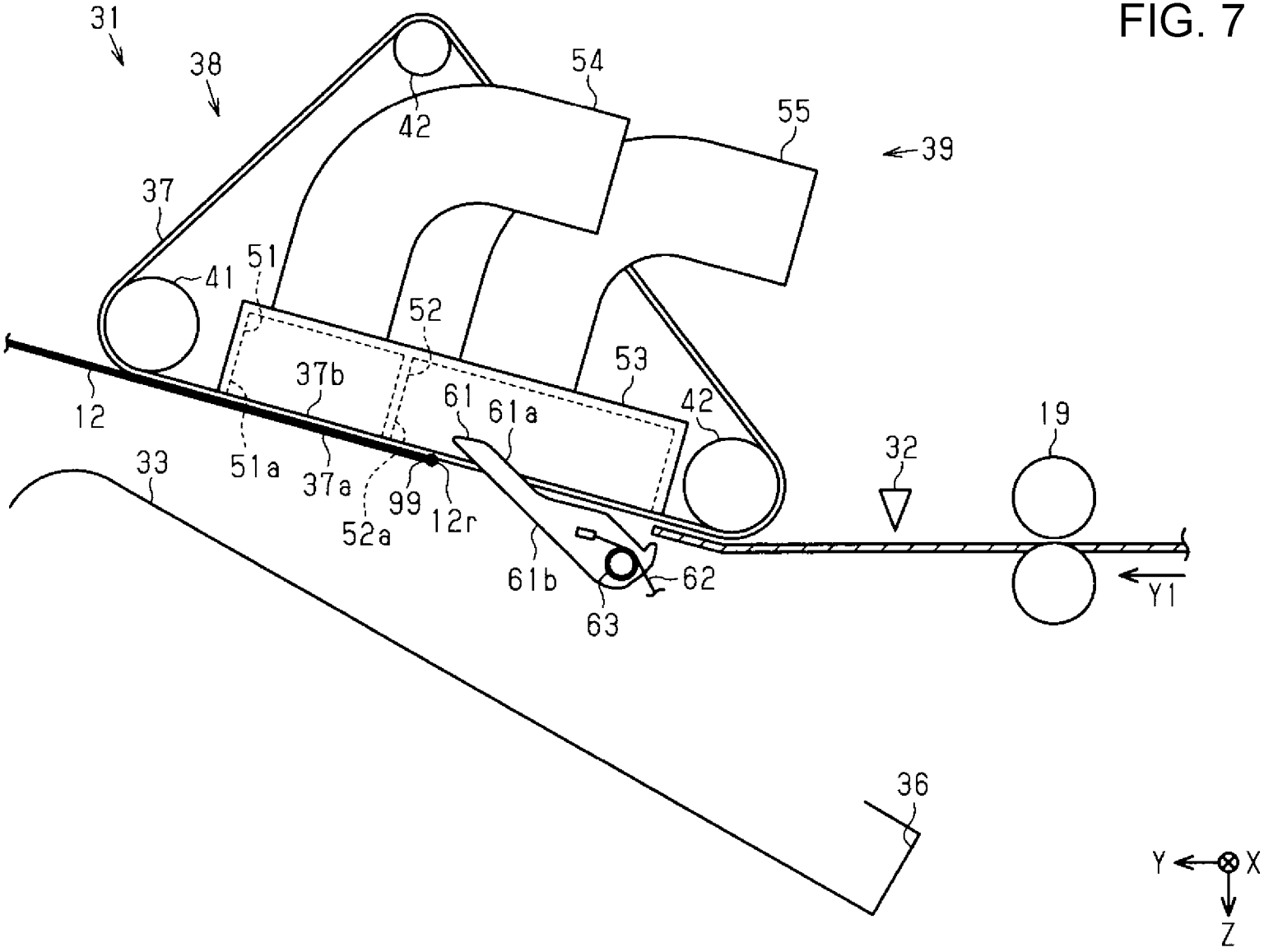
FIG. 7 is a side view schematically illustrating the transport mechanism when the rotating direction of the transport belt is switched.

As illustrated in FIG. 7, after a medium 12 is transported in the first transporting direction Y1 for the predetermined time interval, the rear edge 12*r* of the medium 12 is positioned at the switching position 99. In other words, when the rotating direction of the transport belt 37 is switched from the first rotating direction A1 to the second rotating direction A2, the medium 12 stops temporarily with the rear edge 12*r* of the medium 12 positioned downstream of the separation flaps 61 in the first transporting direction Y1. When the medium 12 leaves the separation flaps 61, each of the separation flaps 61 returns to the first flap position by the urging force of the corresponding pressing member 62. At this time, the first suction chamber 51 draws a portion of the medium 12 near the rear edge 12*r* and causes the portion of the medium 12 to cling to the transport belt 37.

Figure 8:
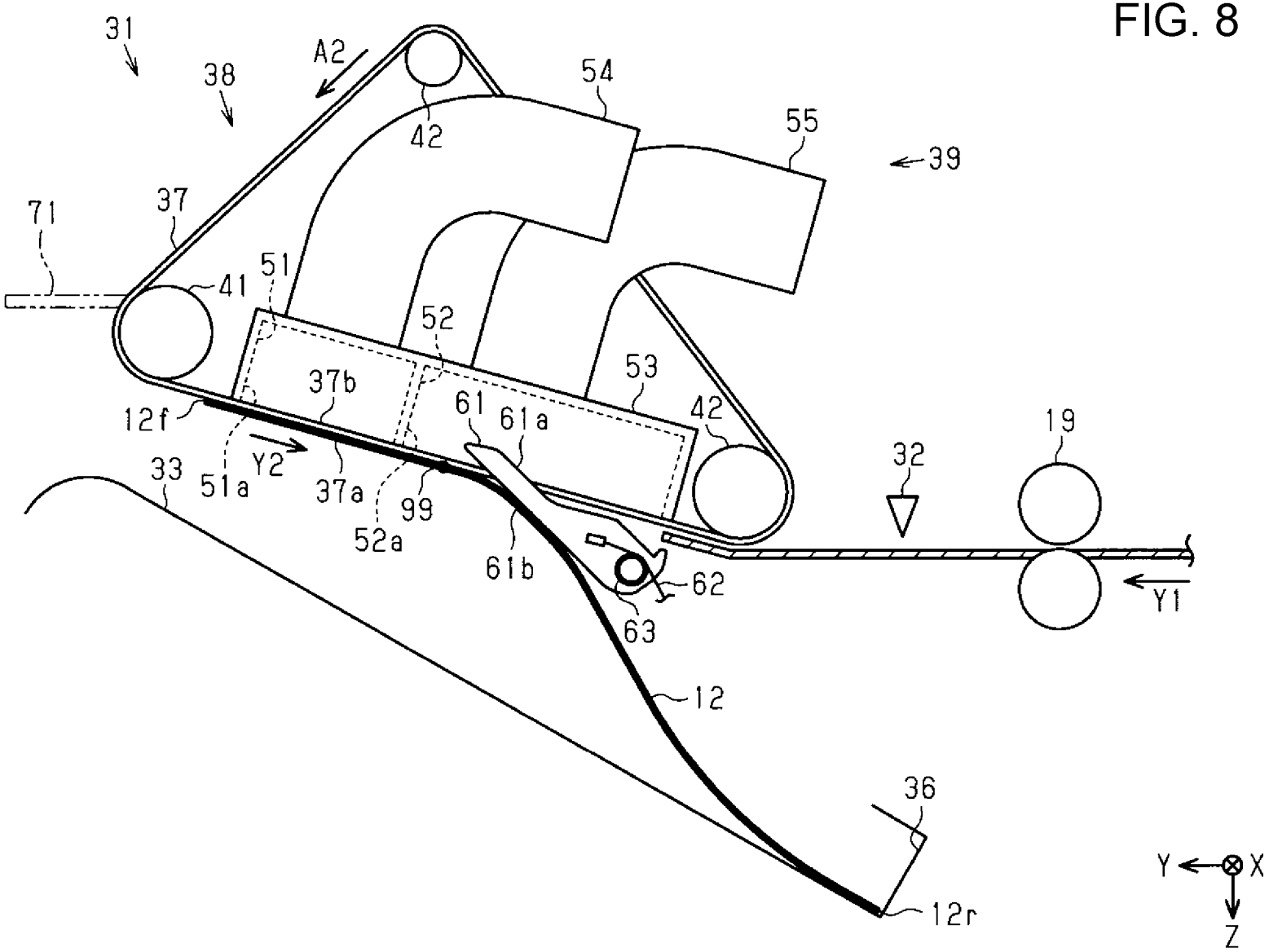
FIG. 8 is a side view schematically illustrating the transport mechanism that transports a medium in a second transporting direction.

As illustrated in FIG. 8, when the transport belt 37 is rotated in the second rotating direction A2, the medium 12 is transported in the second transporting direction Y2. During transportation in the second transporting direction Y2, the medium 12 comes into contact with the separation flaps 61. At this time, the rear edge 12*r* of the medium 12 comes into contact with the lower flap surfaces 61*b*. Further rotation of the transport belt 37 in the second rotating direction A2 transports the medium 12 along the lower flap surfaces 61*b*. The medium 12 is thereby separated from the transport belt 37 in such a manner that separation proceeds from the rear edge 12*r* toward the front edge 12*f*. The medium 12 that has been separated from the transport belt 37 is arranged orderly due to the rear edge 12*r* abutting the orderly arrangement portion 36. Media 12 are stacked in the intermediate stacker 33 while the rear edges 12*r* thereof are lined up.

As described above, when the transport belt 37 is rotated in the second rotating direction A2 and a medium 12 is transported in the second transporting direction Y2 with a portion of the medium 12 cling to the transport belt 37. In this state, the medium 12 and the intermediate stacker 33 are away from each other. This can reduce, for example, the occurrence of the lower side of a transported medium 12 coming into contact with the upper side of a medium 12 previously stacked in the intermediate stacker 33.

Especially in the case of an ink jet type printer that uses water based ink, when a medium 12 with the ink cling thereto slides against anther medium 12, the sliding resistance increases. If the duration for which the lower side of a transported medium 12 is in contact with the upper side of a medium 12 previously stacked on the intermediate stacker 33 becomes long, the sliding resistance between the transported medium 12 and the previously stacked medium 12 may prevent the rear edge 12*r* of the transported medium 12 from touching the orderly arrangement portion 36 appropriately, which may prevent the transported medium 12 from being stacked appropriately in the intermediate stacker 33.

However, cling a medium 12 to the transport belt 37 can reduce the occurrence of the lower side of the transported medium 12 coming into contact with the upper side of the medium 12 stacked previously in the intermediate stacker 33, which enables the transported medium 12 to be stacked appropriately in the intermediate stacker 33.

When a medium 12 is stacked in the intermediate stacker 33, a portion of the medium 12 that is located downstream of the separation flaps 61 in the first transporting direction Y1 is caused to cling to the transport belt 37 by the first suction chamber 51. The medium processing apparatus 11 may include a separation mechanism that separates the medium 12 cling to the transport belt 37 from the transport belt 37 at a position downstream of the switching position 99 in the first transporting direction Y1.

An example of the separation mechanism is a blade 71 as indicated by the dash-dot-dot line in FIG. 8. The blade 71 is formed so as to be rotatable around the shaft of the drive pulley 41. The blade 71 may be preferably made of a material such as rubber that can be deformed elastically. The blade 71 is configured to come into contact with a portion of a medium 12 that is near the front edge 12*f* and is caused to cling to the transport belt 37 by the first suction chamber 51. The blade 71 comes into contact with the medium 12 so as to separate the portion of the medium 12 near the front edge 12*f* from the transport belt 37. In other words, the blade 71 is formed to be rotatable clockwise in FIG. 8. When the blade 71 touches the medium 12, a gap is created between the medium 12 and the transport belt 37. Air thereby enters the first suction chamber 51, which facilitates separation of the medium 12 from the transport belt 37.

The separation mechanism may be formed, for example, of a duct that connects the first suction chamber 51 to atmosphere and a valve that can open/close the duct. When the valve opens, air enters the first suction chamber 51 through the duct, which facilitates separation of the medium 12 from the transport belt 37. Alternatively, for example, the first fan 56 may be stopped in order to separate the portion of the medium 12 near the front edge 12*f* from the transport belt 37. In this case, the control device 67 that controls operation of the first fan 56 serves as the separation mechanism.

Figure 9:
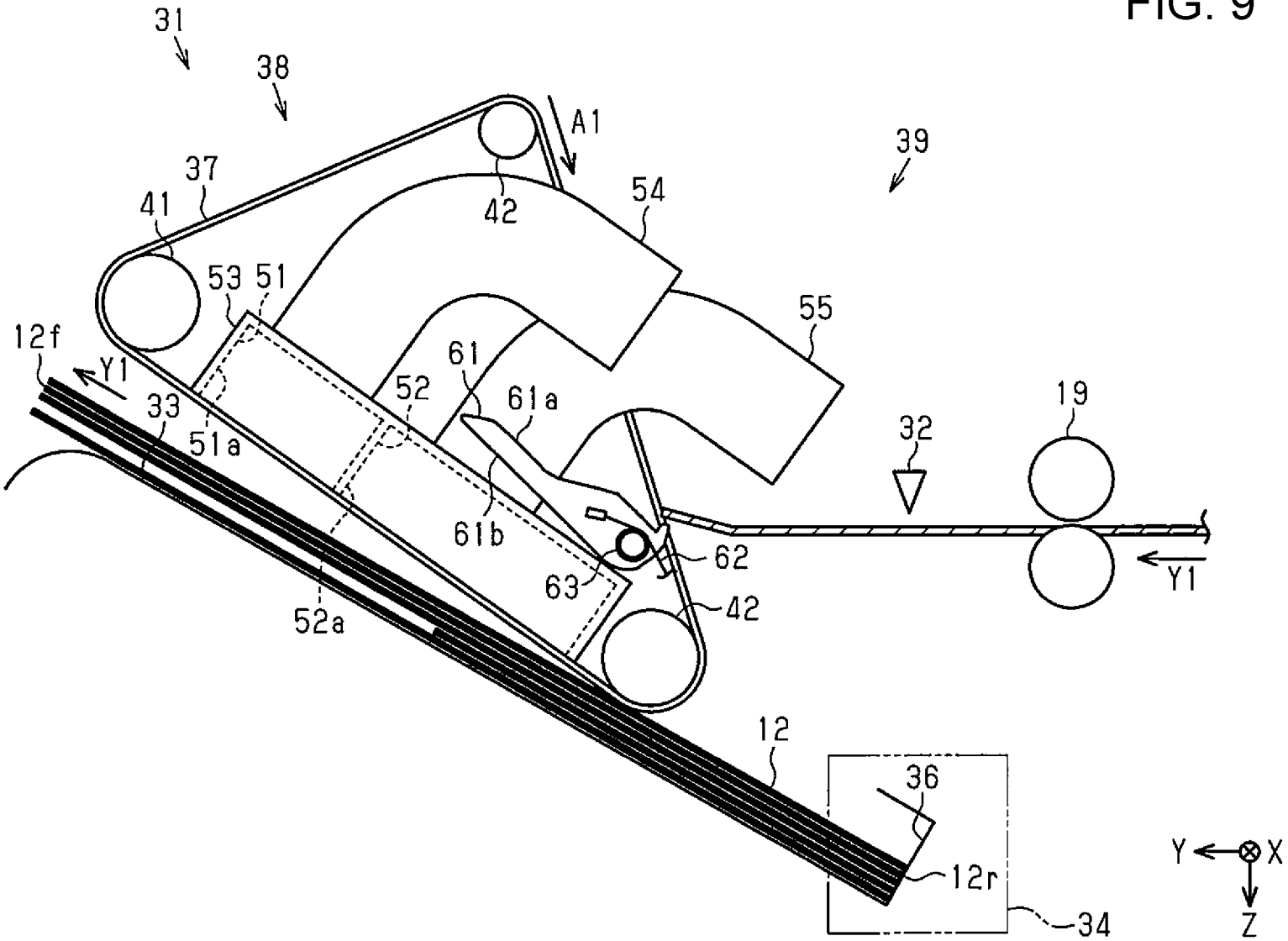
FIG. 9 is a side view schematically illustrating the transport belt that is positioned at a contact position.

As illustrated in FIG. 9, media 12 are stacked with the rear edges 12*r* lined up at orderly arrangement portion 36 irrespective of the lengths of the media 12 in the first transporting direction Y1. If a predetermined number of media 12 (the number of media 12 in each set to be postprocessed) are stacked in the intermediate stacker 33, the postprocessing mechanism 34 performs postprocessing on the media 12. At this time, the transport belt 37 is displaced to the contact position. The transport belt 37 may be displaced to the contact position before the postprocessing mechanism 34 performs postprocessing on the media 12, or the transport belt 37 may be displaced after the postprocessing mechanism 34 performs postprocessing on the media 12.

The control device 67 drives the belt motor 43 in the normal rotation direction with the transport belt 37 being in contact with the media 12 that have been postprocessed. In other words, the rotation mechanism 38 rotates the transport belt 37 that stays at the contact position in the first rotating direction A1 after the postprocessing mechanism 34 performs postprocessing. The media 12 stacked in the intermediate stacker 33 are sent in the first transporting direction Y1 from the intermediate stacker 33 and stacked on the discharge stacker 35.

Next, advantageous effects according to the present embodiment will be described. When the transport mechanism 31 transports a medium 12 and the upstream edge of the medium 12 in the first transporting direction Y1 reaches the switching position 99, the transporting direction of the medium 12 is switched from the first transporting direction Y1 to the second transporting direction Y2. At this time, holes 65 being in communication with the first suction chamber 51 are covered by the medium 12, which causes the medium 12 to cling to the transport belt 37. If holes 65 not covered by the medium 12 are in communication with the first suction chamber 51 when the transporting direction of the medium 12 is switched, an clinging power required to cause the medium 12 to cling to the transport belt 37 may not be obtained.

According to the present embodiment, however, the distance D, which is the distance from the switching position 99 to the opening 51*a* of the first suction chamber 51 in the first transporting direction Y1, is longer than the length R of each hole 65 in the first transporting direction Y1. Accordingly, when the transporting direction of the medium 12 is switched, the holes 65 that are not covered by the medium 12 are not positioned so as to communicate with the first suction chamber 51. The clinging power required to cause a medium 12 to cling to the transport belt 37 is thereby obtained. Thus, a medium 12 can be transported stably.

The length L of the opening 51*a* of the first suction chamber 51 in the first transporting direction Y1 is longer than the pitch P of adjacent holes 65 in the first transporting direction Y1. With this configuration, when a medium 12 is transported, a desired aggregate area of the holes 65 that are in communication with the opening 51*a* of the first suction chamber 51 can be obtained. In other words, a desired level or more of the clinging power can be secured. The medium 12 can be thereby transported stably. Assuming that the length L of the opening 51*a* of the first suction chamber 51 in the first transporting direction Y1 is shorter than the pitch P of adjacent holes 65 in the first transporting direction Y1, the suction power of the first suction chamber 51 corresponding to the length of the first suction chamber 51 varies largely depending on the positional relationship between the opening 51*a* of the first suction chamber 51 and the holes 65 that are in communication with the opening 51*a* of the first suction chamber 51. In this case, the clinging power required to cause a medium 12 to cling to the transport belt 37 may not be secured. With above-described configuration, however, such a problem can be avoided.

In the transport mechanism 31, the length of a portion of a medium 12 stretching over the region in which the holes 65 are formed in the direction orthogonally intersecting the transporting direction of a medium 12 is shorter than the length of the medium 12 in the same direction. With this configuration, holes 65 arranged in the direction orthogonally intersecting the transporting direction are covered by a medium 12 transported. This suppresses the likelihood of the clinging power decreasing due to the holes 65 not covered by the medium 12.

The separation flaps 61 are positioned upstream of the switching position 99 in the first transporting direction Y1, and at least one of the separation flaps 61 is positioned between the transport belts 37 in the direction intersecting the transporting direction. With this configuration, a medium 12 transported in the second transporting direction Y2 are separated from the transport belt 37 due to the separation flaps 61 touching the medium 12. The medium 12 transported by the transport belt 37 can be readily stacked on the stacker.

The medium processing apparatus 11 includes the separation mechanism that separates a medium 12 cling to the transport belt 37 from the transport belt 37 at a position downstream of the switching position 99 in the first transporting direction Y1. With this configuration, while the separation flaps 61 separate the upstream edge of the medium 12 in the first transporting direction Y1 from the transport belt 37, the separation mechanism also separates the downstream edge of the medium 12 in the first transporting direction Y1 from the transport belt 37. The medium 12 transported by the transport belt 37 can be thereby stacked readily on the stacker.

The present embodiment can be modified as below. The present embodiment and the modification examples described below may be combined with each other as long as technical contradiction does not occur. In the transport mechanism 31, the width W of the region in which the holes 65 are formed may be larger than the width of a minimum size medium 12. In this case, the medium processing apparatus 11 may include a cutoff mechanism that cuts off suction through the holes 65 that are located outside the medium 12 in the width direction X.

Figure 10:
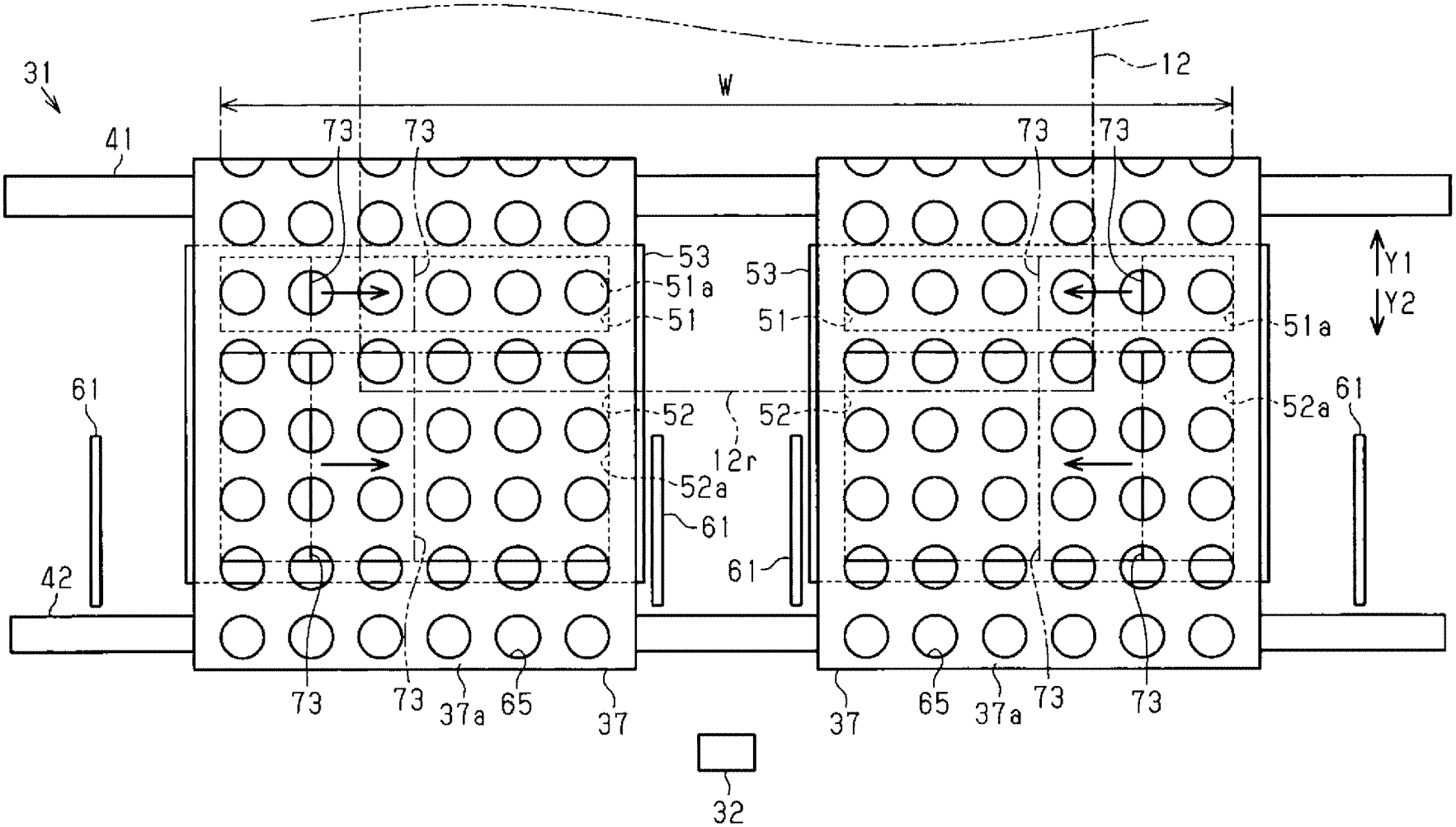
FIG. 10 is a bottom view schematically illustrating a modification example of the transport mechanism.

As illustrated in FIG. 10, the transport mechanism 31 includes shutters 73, as an example of the cutoff mechanism, that can block the first suction chamber 51 and the second suction chamber 52. The shutters 73 are displaceable in the width direction X. Displacing the shutters 73 in the width direction X changes the aggregate area of the first suction chamber 51 and the second suction chamber 52 that open toward the transport belt 37. When the shutters 73 are displaced from outside to inside in the width direction X, the aggregate area of the first suction chamber 51 and the second suction chamber 52 that open toward the transport belt 37 decreases. In this case, the shutters 73 are displaced from positions indicated by the solid lines in FIG. 10 to positions indicated by the dash-dot-dot lines. The shutters 73 thereby block part of the opening 51*a* of the first suction chamber 51 and part of the opening 52*a* of the second suction chamber 52.

When transporting a medium 12 having a width smaller than the width W of the region in which the holes 65 are formed, holes 65 located outside the medium 12 in the width direction X are not covered by the medium 12. In this case, air enters the first suction chamber 51 and the second suction chamber 52 through the uncovered holes 65. This may cause the clinging power to decrease. However, due to the shutters 73 blocking part of the first suction chamber 51 and part of the second suction chamber 52, the holes 65 located outside the medium 12 in the width direction X are blocked from communicating with the first suction chamber 51 and the second suction chamber 52. Thus, suction through holes 65 located outside the medium 12 in the width direction X is blocked. This can suppress the likelihood of the clinging power decreasing.

The cutoff mechanism may be configured to cut off suction through holes 65 located outside a medium 12 by stopping the first fan 56 and the second fan 57. In this case, the control device 67 that controls operation of the first fan 56 and the second fan 57 serves as the cutoff mechanism.

Figure 11:
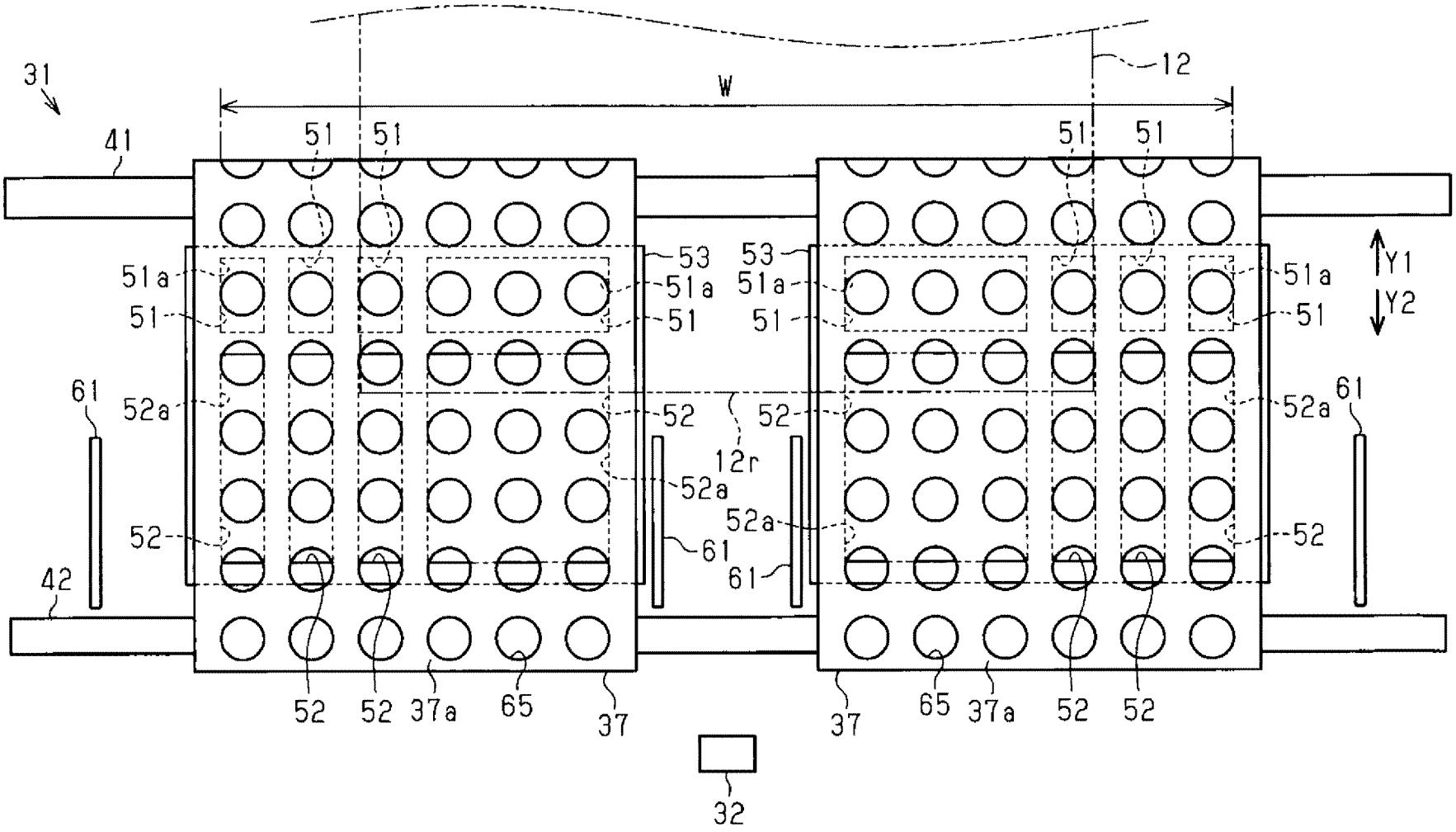
FIG. 11 is a side view schematically illustrating another modification example of the transport mechanism.

In this case, as illustrated in FIG. 11, the transport mechanism 31 includes a plurality of the first suction chambers 51 and the second suction chambers 52 that are arranged in the width direction X. In other words, the suction device 53 includes a plurality of the first suction chambers 51 and the second suction chambers 52 that are arranged in the width direction X. According to this modification example, each of the first suction chambers 51 is provided with the first duct 54 and the first fan 56. Each of the second suction chambers 52 is provided with the second duct 55 and the second fan 57.

The control device 67 stops suction through first suction chambers 51 and second suction chambers 52 that are located outside the medium 12 so as to prevent the holes 65 located outside the medium 12 in the width direction X from communicating with the corresponding first suction chambers 51 and second suction chambers 52. This suppresses the likelihood of the clinging power decreasing even in the case of transporting a medium 12 having a width smaller than the width W of the region in which the holes 65 are formed.

With the modification examples described above, the following advantageous effects can be obtained. The medium processing apparatus 12 includes the cutoff mechanism that cuts off suction through the holes 65 that are located outside the medium 12 in the width direction X of the medium 12. With this configuration, the cutoff mechanism cuts off suction through the holes 65 that are not covered by the medium 12 in the width direction X, which suppresses the likelihood of the clinging power decreasing.

The postprocessing apparatus 14 may be configured to exclude the pressing members 62. For example, each separation flap 61 may have a weight disposed at a position opposite to a region that comes into contact with a medium 12 with respect to the flap shaft 63. The separation flap 61 staying at the second flap position may return to the first flap position by its own weight. The postprocessing apparatus 14 may include a drive source that moves the separation flaps 61, such as a solenoid that moves the separation flaps 61 or a motor that rotates the flap shaft 63.

The postprocessing apparatus 14 may include a roller that nips a medium 12 in collaboration with the transport belt 37 and rotates passively in conjunction with transportation of the medium 12. The roller may be a toothed roller having irregularities on the outer periphery. The toothed roller can reduce the likelihood of transfer of the liquid cling to the bottom side of a medium 12 after double-sided printing.

The postprocessing apparatus 14 may include a pressing device that presses media 12 stacked in the intermediate stacker 33. For example, the pressing device is formed of a plate-like elastic member that is rotatably disposed and a weight that is displaceably disposed. For example, the pressing device may be formed of a member such as the blade 71 illustrated in FIG. 8. The pressing device is configured to press the media 12 stacked in the intermediate stacker 33 when the transport belt 37 is rotated in the first rotating direction A1. When the transport belt 37 is rotated in the second rotating direction A2, the pressing device is displaced to a position away from the media 12.

As the postprocessing, the postprocessing mechanism 34 may punch holes in media 12 or shift each set of media 12 before discharge. As the postprocessing, the postprocessing mechanism 34 may also trim media 12, fold media 12, or perform gathering or bookbinding to make a book from media 12.

The holes 65 formed in the transport belt 37 may have different shapes. The suction power of the first fan 56 and the second fan 57 may be changed depending on the size, weight, or the like, of a medium 12 to be transported.

When each of the separation flaps 61 is positioned at the first flap position, the angle between the upper flap surface 61*a* and the clinging surface 37*a* may be the right angle or an obtuse angle. When each of the separation flaps 61 is positioned at the first flap position, the angle between the lower flap surface 61*b* and the clinging surface 37*a* may be the right angle or an acute angle.

The separation flaps 61 need not touch a medium 12 transported in the first transporting direction Y1. The medium processing apparatus 11 may be a single apparatus that integrates the functions of the intermediate apparatus 15, the postprocessing apparatus 14, and the printing apparatus 13.

The medium processing apparatus 11 may include the printing apparatus 13 and an apparatus that integrates the functions of the intermediate apparatus 15 and the postprocessing apparatus 14. The medium processing apparatus 11 may exclude the intermediate apparatus 15 and the postprocessing apparatus 14. In this case, the medium processing apparatus 11 may be configured to include the printing apparatus 13 having the transport mechanism 31 and a stacker that stacks media 12 transported by the transport mechanism 31. The medium processing apparatus 11 may exclude the postprocessing mechanism 34. The medium processing apparatus 11 may be configured such that a medium 12 on which the recording head 28 has performed recording is transported by the transport mechanism 31 in the first transporting direction Y1 and in the second transporting direction Y2, and the medium 12 is consequently stacked in the stacker disposed in the printing apparatus 13 to line up the rear edge 12*r* of the medium 12.

The recording section 26 is not limited to a recording section that includes a recording head 28 that ejects liquid, but may be a recording section that includes a drum with which a toner image is transferred to a medium 12. The recording section 26 is not limited to the configuration with which recording is performed by ejecting liquid.

The liquid that the recording head 28 ejects is not limited to ink but may be, for example, a liquid-state material in which particles of a functioning material are dispersed or mixed. For example, the recording head 28 may eject a liquid-state material that contains, in the form of a dispersion or melt, an electrode material, a coloring material (pixel material), or the like, to be used for manufacturing liquid crystal displays, Electro Luminescence (EL) displays, surface light emission displays, or the like.

The medium processing apparatus 11 may be a recording apparatus that records images such as characters, pictures, or photographs by causing liquid such as ink to adhere to a medium 12. Such a recoding apparatus may encompass a serial printer, a lateral printer, a line printer, a page printer, or the like. The medium processing apparatus 11 may also be an offset-recording machine, a cloth-recording machine, or the like.

What is claimed is:

1. A medium transport apparatus, comprising:

a transport mechanism that transports a medium; and a stacker that stacks the medium transported by the transport mechanism, wherein the transport mechanism includes a transport belt in which a plurality of holes are formed and that has a loop shape and is transported in a first transporting direction and in a second transporting direction that is opposite to the first transporting direction, a suction clinging mechanism that includes an opening of a first suction chamber and an opening of a second suction chamber that is located upstream of the opening of the first suction chamber in the first transporting direction, the opening of the first suction chamber and the opening of the second suction chamber drawing air through the holes, the suction clinging mechanism causes the medium to cling to the transport belt, and a rotation mechanism that moves the transport belt in the first transporting direction by rotating in a first rotating direction and that moves the transport belt in the second transporting direction by rotating in a second rotating direction that is opposite to the first rotating direction and thereby moves the transport belt in the second transporting direction, the transport mechanism transports the medium in the first transporting direction and after an upstream edge of the medium in the first transporting direction is transported to a switching position, the transport mechanism transports the medium in the second transporting direction and stacks the medium in the stacker, and the switching position is located upstream of the opening of the first suction chamber in the first transporting direction, and a distance from the switching position to the opening of the first suction chamber in the first transporting direction is longer than a length of each of the holes in the first transporting direction.

2. The medium transport apparatus according to claim 1, wherein the length of the opening of the first suction chamber in the first transporting direction is longer than a pitch of adjacent ones of the holes in the first transporting direction.

3. The medium transport apparatus according to claim 1, wherein in the transport mechanism, a length in a region in which the holes are formed in a direction orthogonally intersecting the transporting direction of the medium is shorter than a length of the medium in the direction orthogonally intersecting the transporting direction of the medium.

4. The medium transport apparatus according to claim 1, further comprising a separation flap that separates the medium cling to the transport belt from the transport belt, and another transport belt arranged in a direction orthogonal to the transporting direction of the medium with respect to the transport belt, wherein the separation flap is located at a position that is at least between the transport belt and the other transport belt in the direction orthogonally intersecting the transporting direction and that is upstream from the switching position in the first transporting direction.

5. The medium transport apparatus according to claim 4, further comprising a separation mechanism that separates the medium cling to the transport belt from the transport belt at a position downstream of the switching position in the first transporting direction.

6. A postprocessing apparatus, comprising:

a transport mechanism that transports a medium;

an intermediate stacker that stacks the medium transported by the transport mechanism; and a postprocessing mechanism that performs postprocessing on the medium that is stacked in the intermediate stacker, wherein the transport mechanism includes a transport belt in which a plurality of holes are formed and that has a loop shape and is transported in a first transporting direction and in a second transporting direction that is opposite to the first transporting direction, a suction clinging mechanism that includes an opening of a first suction chamber and an opening of a second suction chamber that is located upstream of the opening of the first suction chamber in the first transporting direction, the opening of the first suction chamber and the opening of the second suction chamber drawing air through the holes, the suction clinging mechanism thereby cling the medium to the transport belt, and a rotation mechanism that moves the transport belt in the first transporting direction by rotating in a first rotating direction and that moves the transport belt in the second transporting direction by rotating in a second rotating direction that is opposite to the first rotating direction and thereby moves the transport belt in the second transporting direction, the transport mechanism transports the medium in the first transporting direction and after an upstream edge of the medium in the first transporting direction is transported to a switching position, the transport mechanism transports the medium in the second transporting direction and stacks the medium in the intermediate stacker, and the switching position is located upstream of the opening of the first suction chamber in the first transporting direction, and a distance from the switching position to the opening of the first suction chamber in the first transporting direction is longer than a length of each of the holes in the first transporting direction.

* * * * *